US005713279A

United States Patent [19]

Iida et al.

[11] Patent Number: 5,713,279

[45] Date of Patent: Feb. 3, 1998

[54] STENCIL CONVEYING DEVICE IN A STENCIL PRINTING MACHINE

[75] Inventors: Kouichiro Iida; Muneaki Kawai, both of Tokyo, Japan

[73] Assignee: Riso Kagaku Corporation, Tokyo, Japan

[21] Appl. No.: 558,161

[22] Filed: Nov. 15, 1995

[30] Foreign Application Priority Data

Nov. 16, 1994 [JP] Japan ..... 6-282213

[51] Int. Cl.[6] ..... B41L 13/06

[52] U.S. Cl. ..... 101/128.4; 101/116

[58] Field of Search ..... 101/121, 122, 101/128.21, 128.4, 116–118, 477; 400/583, 593, 621

[56] References Cited

U.S. PATENT DOCUMENTS

| | | | |
|---|---|---|---|
| 4,628,813 | 12/1986 | Hasegawa et al. | 101/128.4 |
| 4,926,191 | 5/1990 | Takenaka et al. | 400/621 |
| 5,025,725 | 6/1991 | Fukino | 400/621 |
| 5,048,416 | 9/1991 | Iijima | 101/122 |
| 5,438,347 | 8/1995 | Shishido et al. | 101/116 |
| 5,487,333 | 1/1996 | Oshio et al. | 101/128.4 |
| 5,613,437 | 3/1997 | Motoe et al. | 101/128.4 |

FOREIGN PATENT DOCUMENTS

| | | | |
|---|---|---|---|
| 0652112 | 5/1995 | European Pat. Off. . | |
| 238969 | 9/1989 | Japan | 400/621 |
| 88270 | 3/1990 | Japan | 400/621 |
| 118262 | 4/1992 | Japan | 400/621 |

OTHER PUBLICATIONS

Patent Abstracts Of Japan, vol. 014 No. 305 (M–0992), 29 Jun. 1990, & JP–A–02 098480 (Tokyo Koku Keiki KK), 10 Apr. 1990, *abstract.

Patent Abstracts Of Japan, vol. 012 No. 416 (M–759), 4 Nov. 1988, & JP–A–63 153196 (Gakken Co Ltd), 25 Jun. 1988, *abstract.

*Primary Examiner*—Stephen R. Funk

*Attorney, Agent, or Firm*—Sughrue, Mion, Zinn, Macpeak & Seas, PLLC

[57] ABSTRACT

A stencil printing machine in which a rolled stencil is cut for obtaining a printing stencil of a printing image, the stencil printing machine includes: printing-stencil making section including a thermal head and a platen roller, for making the printing stencil from the rolled stencil held and conveyed by the thermal head and the platen roller; a cutter for cutting the rolled stencil to obtain the printing stencil; and controller for controlling the platen roller such that the front end portion of the rolled stencil separated from the printing stencil by the cutter is moved a predetermined distance backwardly, towards the printing-stencil making section, and then moved forwardly beyond the cutter to a predetermined position.

4 Claims, 8 Drawing Sheets

STENCIL CONVEYING DEVICE IN A STENCIL PRINTING MACHINE

BACKGROUND OF THE INVENTION

1. Field of the Invention

This invention relates to stencil printing machines, and more particularly to a stencil printing machine in which a stencil paper is cut with a cutter to form a printing stencil, and the front end portion of the stencil paper which has been separated from the printing stencil is conveyed to a predetermined position.

2. Description of the Related Art

A stencil printing machine is known in the art which performs a printing operation as follows: While a stencil paper provided in the form of a roll is being conveyed towards a rotary cylindrical drum (hereinafter referred to merely as "a drum", when applicable) with a platen roller provided in its printing-stencil making means, a thermal head processes the stencil paper according to a given original to make a printing stencil, and the stencil paper thus processed is conveyed towards the drum, and cut with a cutter to separate the printing stencil therefrom, and the printing stencil is wound on the drum.

When, in the above-described printing machine, the stencil paper is cut with the cutter to obtain the printing stencil, the front end of the printing stencil is clamped with clamping means provided on the outer cylindrical surface of the drum. Under this condition, the drum is turned, so that the stencil is wound on the outer cylindrical surface of the drum. On the other hand, the front end portion of the stencil paper which is separated from the printing stencil is forwarded a predetermined distance towards the drum, and held there until the next printing-stencil making operation is started.

The aforementioned cutter for cutting the stencil paper comprises a stationary blade which extends in the direction of width of the stencil paper, and a driving blade provided confronted with the stationary blade. The cutter is, for instance, a guillotine type cutter, shuttle type cutter, or spiral blade type cutter. In the case of the guillotine type cutter, the driving blade is moved while rubbing the stationary blade, to cut the stencil paper. The shuttle type cutter has a stationary blade which extends in the direction of width of the stencil paper, and a disk-shaped rotary blade. The disk-shaped rotary blade is turned so that it is moved from one end of the stationary blade to the other end while being in sliding contact with the latter, to cut the stencil paper. The spiral blade type cutter comprises a stationary blade which is extended in the direction of width of the stencil paper, and a rotary blade which is a spiral blade formed on the outer cylindrical surface of a round rod. The round rod is turned so that the rotary blade is moved from one end of the stationary blade to the other end while being in slide contact with the latter, to cut the stencil paper.

The above-described cutter is set in the stencil conveying path between the printing-stencil making means and the rotary cylindrical drum. In order to positively convey the stencil paper from the printing-stencil making means to the clamp means on the drum, upper and lower guide boards are laid over the cutter which are suitably spaced from each other. More specifically, the upper and lower guide boards are each divided into two parts, thus providing a space (gap) for the cutter. The space has a predetermined width in the direction of movement of the stencil paper, and a length larger than the width of the stencil paper so that the edge of the stationary blade may contact the driving blade rotary blade, and, when the driving blade or rotary blade is driven, its edge may not contact the guide boards.

In the case where the stencil paper is tensioned to some extent, it is cut with the cutter as follows: When the driving blade is moved downwardly or upwardly to contact the stationary blade, the stencil paper is cut while being slackened in the direction in which the driving blade is moved. In the case, too, where the rotary blade is turned to contact the stationary blade, the stencil paper is cut while being slackened in the direction in which the rotary blade is turned.

After the stencil paper is cut to obtain the printing stencil in the above-described manner, the front end portion of the stencil paper which has been separated from the printing stencil being cut with the cutter, is held slackened. However, when the driving blade returns to its initial position, the front end portion of the stencil paper is led in the driving-blade returning direction while being in contact with the side surface of the driving blade. Finally, the front end portion may be led to the space defined by the guide boards. In the case of the rotary blade, the front end portion of the stencil paper, being slackened in the above-described manner, is caused to contact the side surface of the rotary blade. Hence, the front end portion is led in the direction in which the rotary blade is turned. As a result, similarly as in the case of the driving blade, the front end portion may be led to the space defined by the guide boards. This phenomenon occurs particularly when the stencil paper is cut which is not tensioned.

In general, the front end portion of the stencil paper thus cut, when left as it is, is curled by the change in temperature or in humidity. Hence, if the front end portion thus curled is conveyed for the next printing-stencil making operation, then it may enter the space defined by the guide boards, thus obstructing the conveyance of the stencil paper. In order to overcome this difficulty, control is so made that, after the stencil paper is cut to obtain the printing stencil, the front end portion of the stencil paper thus cut is conveyed a predetermined distance beyond the cutter to a certain position on the upper and lower guide boards, so as to be ready for the next printing-stencil making operation.

However, the control may not be effective. If, as was described above, the front end portion of the stencil paper is led into the space defined by the upper and lower guide boards, then even if the stencil paper is conveyed the above-described predetermined distance, it is impossible to move the front end portion beyond the cutter to the certain position on the upper and lower guide boards, which obstructs the smooth conveyance of the stencil paper.

SUMMARY OF THE INVENTION

In view of the foregoing, an object of the invention is to provide a stencil printing machine in which even if, after the stencil paper is cut with the cutter to obtain a printing stencil, the front end portion of the stencil paper which has been separated from the printing stencil enters the space defined by the upper and lower guide boards, it can be moved from the space, so that the front end portion can be positively conveyed toward the rotary cylindrical drum for the stencil-making and printing operation.

According to a first aspect of the present invention, there is provided a stencil printing machine in which a rolled stencil is cut for obtaining a printing stencil of a printing image, the stencil printing machine comprising: printing-stencil making means including a thermal head and a platen roller, for making the printing stencil from the rolled stencil held and conveyed by the thermal head and the platen roller; a cutter for cutting the rolled stencil to obtain the printing stencil; and control means for controlling the platen roller such that the front end portion of the rolled stencil separated from the printing stencil by the cutter is moved a predetermined distance backwardly, towards the printing-stencil making means, and then moved forwardly beyond the cutter to a predetermined position.

According to a second aspect of the invention, there is provided a stencil printing machine in which a rolled stencil is cut for obtaining a printing stencil of a printing image, the stencil printing machine comprising: printing-stencil making means including a thermal head and a platen roller, for making the printing stencil from the rolled stencil held and conveyed by the thermal head and the platen roller; a cutter for cutting the rolled stencil to obtain the printing stencil; a first guide board unit including a pair of upper and lower guide boards arranged upstream of the cutter as viewed in a stencil conveying direction; a second guide board unit including a pair of upper and lower guide boards arranged downstream of the cutter as viewed in the stencil conveying direction; and control means for controlling the platen roller such that the front end portion of the rolled stencil separated from the printing stencil cut by the cutter is moved a predetermined distance backwardly to be held between the first guide board unit, and then moved forwardly to be held between the second guide board unit.

The stencil printing machine organized as described above operates as follows: After the rolled stencil is cut with the cutter to obtain a printing stencil, the front end portion of the rolled stencil which is separated from the printing stencil is moved backwardly a predetermined distance, towards the printing-stencil making means. In other words, even if the stencil paper, when cut, is slackened to cause its front end portion to enter the space, the front end portion is returned therefrom to the pair of guide boards of the first guide board unit located before the cutter. Thereafter, the front end portion of the rolled stencil is conveyed a predetermined distance beyond the cutter to the position where the pair of guide boards of the second guide board unit are located, and stopped there. This feature eliminates the difficulty that the rolled stencil is not smoothly conveyed with its front end portion when it enters the space provided for the cutter. The front end portion of the stencil paper is held in the pair of guide boards of the second guide board unit until the following printing-stencil making operation is started. Even if ambient conditions such as ambient temperature and humidity change while the front end portion is held between the guide boards, its curling is limited by guide boards. Therefore, in the following stencil-making and printing operation, the stencil paper can be positively conveyed to the rotary cylindrical drum.

DETAILED DESCRIPTION OF THE PREFERRED EMBODIMENTS

A stencil printing machine, which constitutes a preferred embodiment of the invention, will be described with reference to the accompanying drawings.

Figure 1:
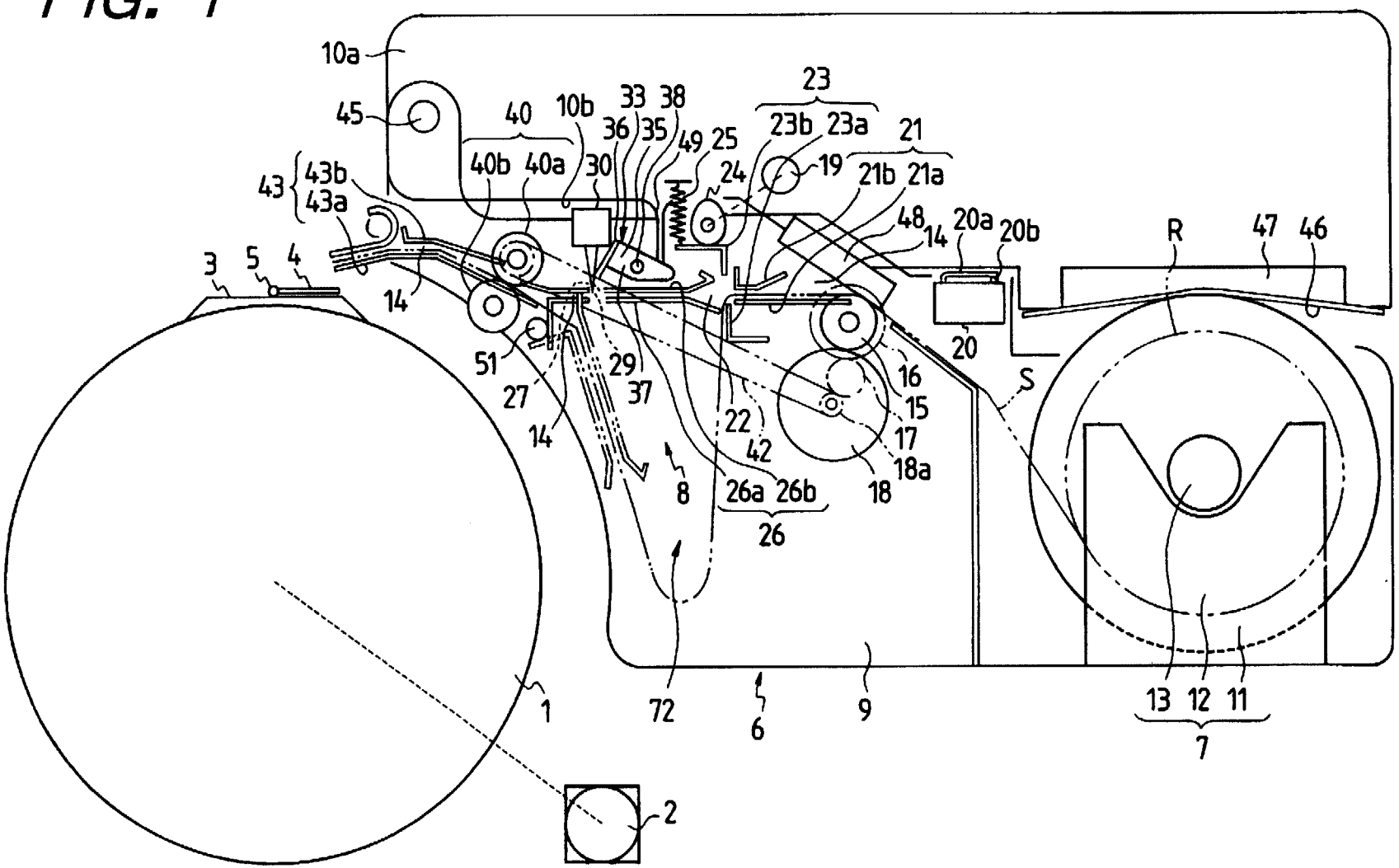
FIG. 1 is a side view showing the arrangement of a stencil printing machine according to the invention.
Figure 2:
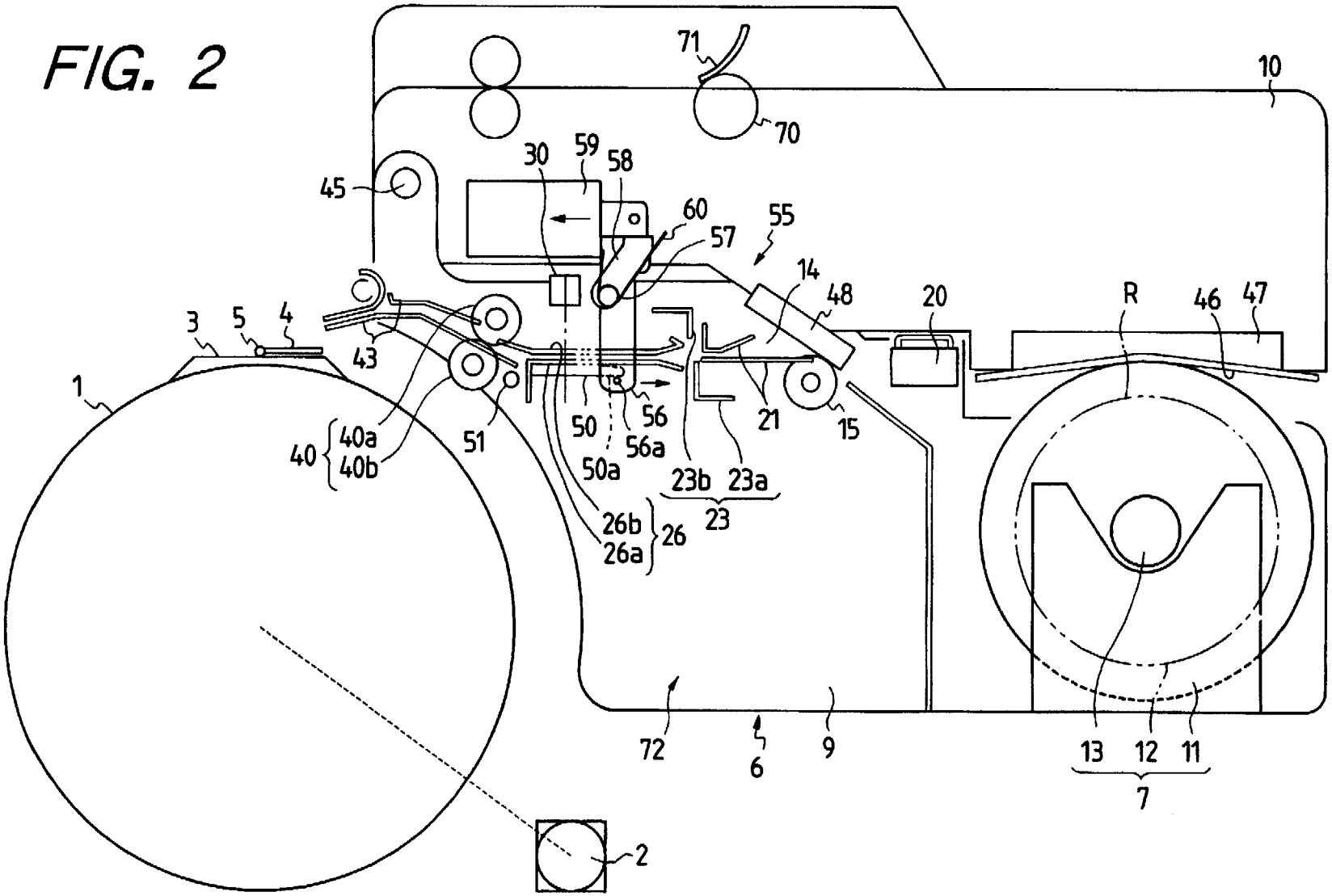
FIG. 2 is a side view showing a relay-stencil-guide-board locking structure in the printing machine.
Figure 3A:
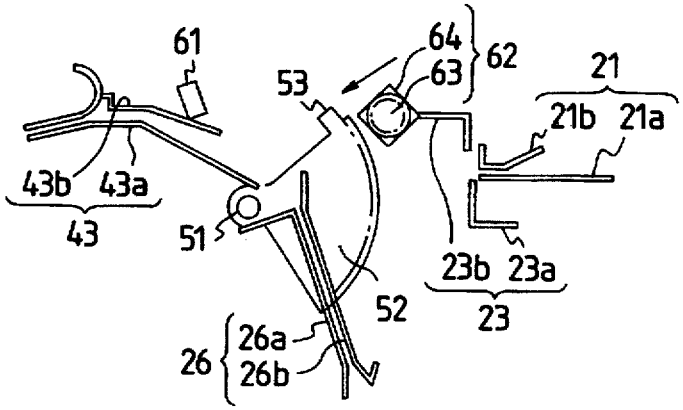
FIGS. 3(*a*) to 3(*d*) are diagrams for a description of a relay-stencil-guide-board returning structure in the printing machine, and its operation.
Figure 3B:
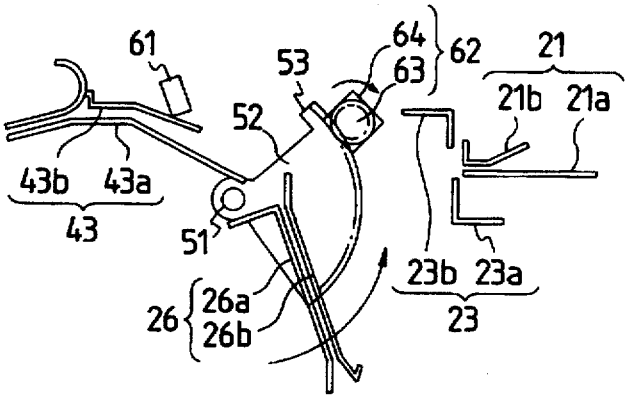
Figure 3C:
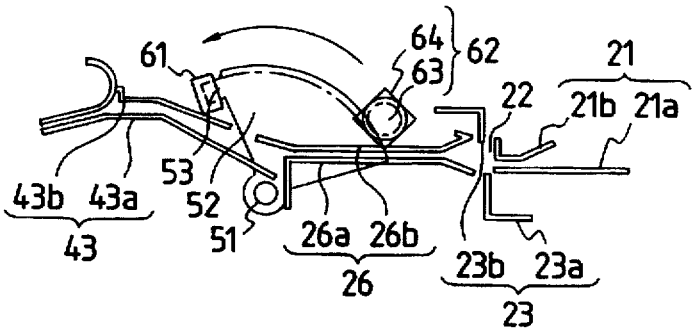
Figure 3D:
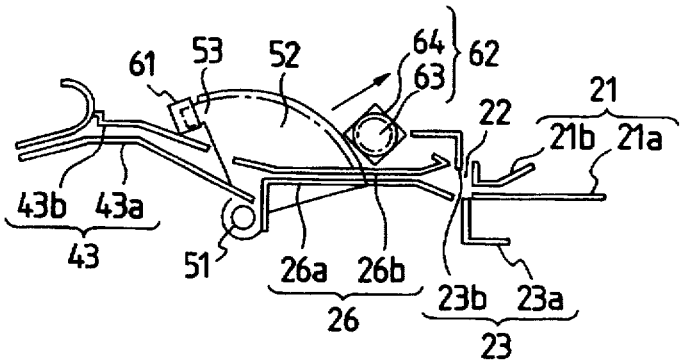

FIG. 1 is a side view showing the stencil printing machine according to the invention. FIG. 2 is a side view showing a relay-stencil-guide board locking structure in the printing machine. FIGS. 3(*a*) to 3(*d*) are diagrams for a description of a relay-stencil-guide-board returning structure in the printing machine, and its operation.

Shown in the left part of FIG. 1 is a rotary cylindrical drum 1, which is turned counterclockwise (in FIG. 1) by a main motor 2. The cylindrical wall of the drum 1 includes a printing region which is ink-permeable.

On the remaining region of the cylindrical wall of the drum 1, which is not ink-permeable, a stage member 3 is provided which extends along the generating line of the outer cylindrical surface. A stencil clamping plate 4 is provided on the stage member 3 which cooperates with the stage member 3 to clamp one end of a stencil paper S. The stencil clamping plate 4 is swung through 180° on the stage member 3 by a clamp driving unit (not shown). More specifically, the stencil clamping plate 4 pivots about a pivot 5 to take a clamp position (shown in FIG. 1) where the stencil clamping plate 4 cooperates with the stage member 3 to lock the front end of the stencil paper S which is conveyed through a printing-stencil making unit 6, and a non-clamp position which is angularly shifted about 180° from the clamp position.

The aforementioned printing-stencil making unit 6 is provided on the right of the drum 1 in FIG. 1. The body 9 of the printing-stencil making unit (hereinafter referred to as "a unit body 9", when applicable) has a stencil paper holding section 7 which holds a roll of stencil paper S, and a conveying mechanism 8 which conveys the stencil paper S beginning with its one end. A pressure plate 10 is pivotably supported on the unit body 9.

As shown in FIG. 1, the stencil paper holding section 7 is arranged the right part of the unit body 9, and holds a stencil paper S provided in the form of a roll as indicated at R. The stencil paper holding section 7 further includes stencil paper flanges 11, and a flange supporting member 12. The stencil paper flanges 11 have a flange shaft 13 at the center. The stencil paper flanges 11 are engaged with the core of the roll R of stencil paper, to support the roll R from both sides in such a manner that the roll R can be replaced if necessary. The flange supporting member 12 rotatably supports the flange shaft 13 of the stencil paper flanges 11 which hold the roll R of stencil paper in the above-described manner.

A stencil conveying path 14 is provided between the stencil paper holding section 7 of the unit body 9 and the stage member 3 of the drum 1, to convey the stencil paper S towards the drum 1. A platen roller 15 is provided on the stencil conveying path 14 near the stencil paper holding section 7.

A gear 16 is fixedly mounted on the platen roller 15. The gear 16 is coupled through an intermediate gear 17 to a gear 18*a* which is mounted on the rotary shaft of a write/feed motor 18. That is, the rotation of the motor 18 is transmitted through the intermediate gear 17 to the platen roll 15.

A pressure plate set sensor 20 is provided between the stencil paper holding section 7 and the platen roller 15. The sensor 20 is to determine whether the pressure plate 10 is opened with respect to the unit body 9 or whether it is closed with respect to the unit body 9. The pressure plate set sensor 20 is made up of a micro-switch or the like, having an operating piece 20*a*, and contact means 20*b*. When the pressure plate 10 is closed with respect to the unit body 9, the operating piece 20*a* of the sensor 20 is engaged with the contact means 20*b* to turn on the sensor 20, so that the latter 20 outputs a pressure plate set signal indicating that the pressure plate 10 is closed with respect to the unit body 9.

As shown in FIG. 1, a stencil paper guide board unit 21 including upper and lower guide board 21*b* and 21*a*, is provided on the left side of the platen roller 15. The upper and lower guide boards 21*b* and 21*a* are spaced a predetermined distance from each other to form the aforementioned stencil conveying path 14, thus functioning as follows: That is, those guide boards 21*a* and 21*b* receive the stencil paper S conveyed thereto from the platen roller 15, and guide it towards the drum.

A space (or gap) 22 is provided downstream of the stencil paper guide board unit 21 (on the side of the drum 1) as viewed in the stencil conveying direction. A cutter 23 is provided in the space 22. The cutter 23 includes a stationary blade 23*a* and a movable blade 23*b*, to cut the stencil paper S which has been processed with a thermal head according to a given original, thus providing a printing stencil. The stationary blade 23*a* is fixedly provided below the front end of the lower guide board 21*a* so that the end of the stationary blade 23*a* may not protrude into the stencil conveying path 14. The movable blade 23*b* is provided above the stencil conveying path and confronted with the stationary blade 23*a*. The movable blade 23*b* is coupled to an eccentric cam 24 which is driven by a cutter motor 19. As the eccentric cam 24 rotates, the movable blade 23*b* is moved up and down, to cut the stencil paper S. One revolution of the eccentric cam 24 corresponds to one up-and-down movement of the movable blade.

When the eccentric cam 24 is not in operation, the movable blade 23*b* is held away from the stencil conveying path 14 being urged upwardly by the elastic force of a tension spring 25. The above-described cutter 23 may be a guillotine type cutter, a shuttle type cutter, or a spiral edge type cutter.

A relay stencil guide board unit 26 comprising upper and lower guide boards 26*b* and 26*a* is provided on the left side of the stencil cutter 23. The lower guide board 26*a* is provided with a plate-shaped hook 50 which has a sloped portion 50*a* at the front end. The lower guide board 26*a* and the upper guide board 26*b* are spaced a predetermined distance from each other to define the aforementioned stencil conveying path 14. Those guide boards 26*a* and 26*b* receive the stencil paper S which is conveyed thereto from the stencil paper guide board unit 21, and guide it towards the drum 1. The relay stencil guide board unit 26 together with the stencil paper guide board unit 21 forms the stencil conveying path 14 which is linear, passing through the aforementioned space 22. The space below the relay stencil guide board unit 26 is employed as a stencil receiving section 72 which receives a slackened stencil paper as indicated by the two-dot chain lines in FIG. 1.

The relay stencil guide board unit 26 is coupled to a sector gear 52 which is pivotably mounted through a shaft 51 on the unit body 9. A shielding piece 53 extends from the end face (on the side of the drum 1) of the sector gear 52. Locking means 55 adapted to hold the relay stencil guide board unit 26 is provided above the relay stencil guide board unit 26 so that the relay stencil guide board unit 26 together with the stencil paper guide board unit 21 forms the stencil conveying path 14 which is linear, passing through the aforementioned space 22. The locking means 55 includes: a locking board 56 with a pin 56*a* at its one end which is locked to the hook 50 of the lower guide board 26*a*; a link 58 coupled through a shaft 57 to the other end of the locking board 56; a guide board solenoid 59 connected to the link 58; and a spring 60 which urges the pin 56*a* to engage with the hook 50.

With the locking means 55, the relay stencil guide board unit 26 is prevented from being locked before the stencil paper S is fixedly secured to the drum 1 with the stencil clamping board 4. That is, when the guide board solenoid 59 is activated (on), the link 58 is turned counterclockwise about the shaft 51, so that the pin 56*a* is disengaged from the hook 50 of the lower guide board 26*a*. When the guide board solenoid 59 is deactivated (off), the pin 56*a* is moved back to its return position by the elastic force of the spring 60 and the pin 56*a* is engaged with the hook 50. When the guide board solenoid 59 is activated and deactivated the relay stencil guide board unit 26, not engaging with the hook 50, is pivoted downwardly about the shaft 51.

The time instant that the guide board solenoid 59 has been activated the following operations occur: The pin 56*a* is disengaged from the hook 50 of the relay stencil guide board unit 26 which swings about the shaft 51 by it own weight while slackening the print stencil S which is conveyed by the rotation of the platen roller 15. And, in the case where the pin 56*a* is moved back to the return position, the relay stencil guide board unit 26 is swung to the position where it is engaged with the hook 50 again.

A guide board sensor 61 is positioned on the locus of swing of the shielding piece 53 of the sector gear 52. The guide board sensor 61 is made up of a light emitting unit and a light receiving unit, to detect whether or not the relay stencil guide board unit 26 is at the return position with the pin 56*a* engaged with the hook 50 of the lower guide board 26*a*. As shown in FIG. 3, the unit body 9 has a drive unit 62 which engages with the sector gear 52 to move the relay stencil guide board unit 26 to the return position. The drive unit 62 includes: a guide board drive gear 63 which is engaged with the sector gear 52; and a guide board motor 64 which turns the guide board drive gear 63. As shown in FIGS. 3(*a*) and 3(*b*), the drive unit 62 is moved by a direct acting mechanism such as a solenoid during the period of time which elapses from the time instant that the guide board drive gear 63 is disengaged from the sector gear 52 until the gear 63 is engaged with the gear 52.

When the guide board drive gear 63 engaged with the sector gear 52 is turned clockwise as shown in FIG. 3(*b*), the sector gear 52 is pivoted counter-clockwise about the shaft 51 as shown in FIG. 3(*d*). This pivoting is continued until the relay stencil guide board unit 26 together with the stencil guide board unit 21 form the stencil conveying path 14 which is linear, passing through the aforementioned space 22. Under this condition, the pin 56*a* is locked to the hook 50 of the lower guide board 26*a*. At the same time, the shielding piece 53 intercepts the output light beam of the guide board sensor 61, so that the latter 61 outputs a signal indicating that the relay stencil guide board unit 26 has moved back to the return position.

As indicated by the broken line in FIG. 1, the upper guide board 26*b* of the relay stencil guide board unit 26 has an opening 27 which is extended in the direction of width of the unit body 9. On the other hand, the lower guide board 26*a* of the relay stencil guide board unit 26 has an opening 29 in correspondence to the opening 27 of the upper guide board 26*b*. A stencil stand-by sensor 30 is provided above the opening 27 of the upper guide board 26*b*. The sensor 30 includes a light emitting unit and a light receiving unit, to optically detect whether or not the stencil paper S is present which is to be conveyed along the stencil conveying path 14.

A stencil stopper member 33 is provided above the upper guide board 26*b* between the stencil cutter 23 and the stencil detecting sensor 30. The stencil stopper member 33 is made up of a flat stopper plate 36, and a pair of side walls 37 which extend from both ends of the stopper plate 36 in the same direction forming right angles with the stopper plate 36. The stencil stopper member 33 is pivotably mounted on the sides of the unit body 9 through a mounting shaft 38 which extends through the side walls 37. When the pressure plate 10 is closed with respect to the unit body 9, the stopper plate 36 is positioned perpendicular to the linear stencil conveying path 14 so that it interrupts the stencil conveying path 14 with its own weight. Under this condition, the front end portion of the stencil paper S is manually inserted in the stencil conveying path 14 between the upper and lower guide boards **26*b* and 26*a* until the end of the stencil paper S abuts against the inner surface of the stopper plate 36. That is, the end of the stencil paper S is positioned by the inner surface of the stopper plate 36**. Thus, the stencil paper S has been initially set.

In the unit body 9, a stencil conveying roller unit 40 is arranged on the left side of the relay stencil guide board unit 26. The stencil conveying roller unit 40 includes a driving roller **40*a*, and a driven roller 40*b*. The driving roller 40*a* is coupled through an electro-magnetic clutch 41 and a driving endless belt 42 to the write/feed motor 18. When the electro-magnetic clutch 41 is activated, the rotation of the write/feed motor 18 is transmitted through the belt 42 to the driving roller 40*a*. On the other hand, when the electro-magnetic clutch 41 is deactivated, the rotation of the motor 18 is not transmitted to the driving roller 40*a*. When the rotation of the motor 18 is transmitted to the driving roller 40*a*, the latter 40*a* is turned clockwise in FIG. 1, and accordingly the driven roller 40*b* is turned counterclockwise, so that the stencil paper S is conveyed towards the drum 1. The peripheral speed of the stencil conveying roller unit 40 is set lower than that of the platen roller 15. Thus, the stencil paper S is gradually slackened between the stencil conveying roller unit 40 and the platen roller 15**.

A discharging guide board unit 43 including upper and lower guide boards **43*b* and 43*a* is arranged on the upper left side of the stencil conveying roller unit 40. The lower guide board 43*a* and the upper guide board 43*b* are spaced a predetermined distance from each other to define the stencil conveying path 14, and their front end portions are located above the stage 3 of the drum 1. The discharging guide board unit 43 receives the stencil paper S while is conveyed thereto from the stencil conveying roller unit 40, and guide it towards the drum 1**.

The pressure plate 10 is pivotably mounted through its base portion **10*a* on a shaft 45 which is provided in the unit body 9 on the side of the drum 1. The inner wall 10*b* of the pressure plate 10 has a recess 47 in alignment with the roll R of stencil paper. A stencil paper tensioning member 46 made of a metal leaf spring is supported on both ends of the recess 47, so as to tension the roll R to some extent. When the pressure plate 10 is closed with respect to the unit body 9, the stencil paper tensioning member 46 is pushed against the outer cylindrical surfaces of the stencil paper flanges 11, thus applying a certain tension to the stencil paper when let out of the stencil paper holding section. The stencil paper tensioning member 46** may be made of a sheet material of soft resin or the like.

A thermal head 48 is provided on the central part of the inner wall **10*b* of the pressure plate 10 in correspondence to the platen roller 15. The thermal head 48 cooperates with the platen roller 15 to hold the stencil paper S which is supplied thereto being unwound from the roll R, and thermally perforates it to make a printing image according to a given original. The stencil paper S thus processed is conveyed towards the drum 1**.

A tongue-shaped engaging piece 49 is provided between the shaft 45 and the thermal head 48 on the inner wall **10*b* of the pressure plate 10 in correspondence to the stencil stopper member 33. More specifically, the tongue-shaped engaging piece 49 is vertically extended from the inner wall 10*b* in correspondence to one of the side walls 37 of the stencil stopper member 33. When the pressure plate 10 is closed with respect to the unit body 9, the tongue-shaped engaging piece 49 pushes the upper end face of the side wall 37 which is located on the side which is opposite to the side where the stopper plate 36 is. As a result, the side walls 37 are turned about the mounting shaft 38 so that the stopper plate 36 is moved upwardly from the stencil conveying path 14. When the pressure plate 10 is completely closed, the stencil conveying path 14 is opened, so that the stencil paper S can be forwarded towards the drum 1**.

In the stencil printing machine thus organized, the stencil paper S is initially set as follows: First, the pressure plate 10 is opened with respect to the unit body 9. As a result, the stopper plate 36 is turned about the mounting shaft 38 by its own weight to its set position, to interrupt the stencil conveying path 14. Under this condition, the front end portion of the stencil paper S is inserted until it abuts against the inner surface of the stopper plate 36. Thereafter, the pressure plate 10 is closed with respect to the unit body 9. When the pressure plate 10 is closed in this way, the tongue-shaped engaging piece 49 of the pressure plate 10 pushes the side walls 37 of the stopper plate 36. As a result, the side walls 37 are turned about the mounting shaft 38 to a retracting position so that the stopper plate 36 is retracted from the stencil conveying path being moved upwardly. That is, the stopper plate 36 is retracted from the stencil conveying path 14, so that the stencil conveying path 14 is opened. In the above-described operation, the pressure plate set sensor 20 determines whether or not the pressure plate 10 is closed.

Figure 4:
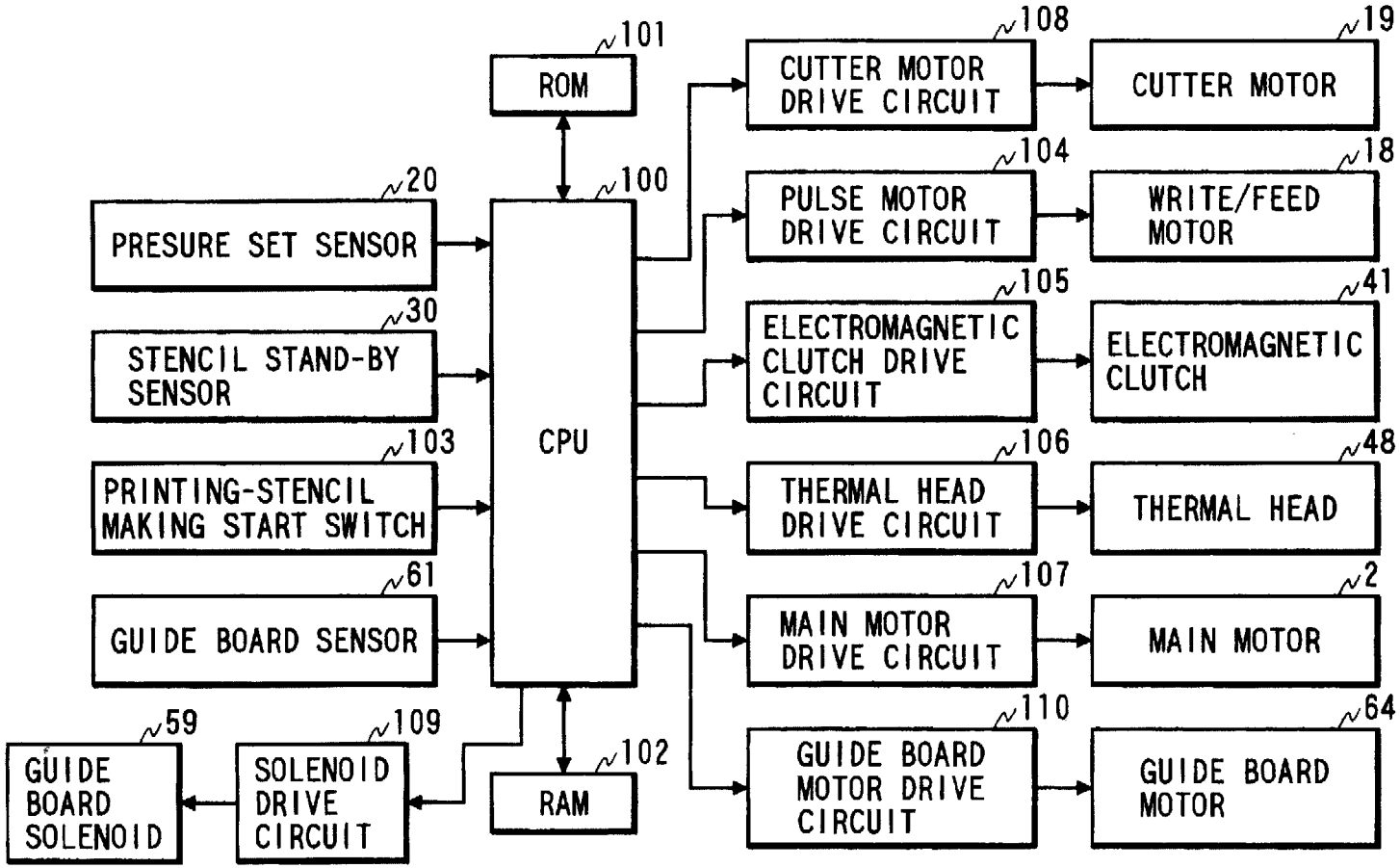
FIG. 4 is a block diagram showing a control system in the printing machine.

FIG. 4 shows an example of a control system provided for the above-described stencil printing machine.

The control system includes the main motor 2, the write/feed motor 18, the cutter motor 19, the pressure plate set sensor 20, the stencil detecting sensor 30, the electromagnetic clutch 41, the thermal head 48, the guide board solenoid 59, the guide board sensor 61, and the guide board motor 64 which are all described above. The control system further includes a CPU 100, a ROM 101, a RAM 102, a printing-stencil making start switch 103, a pulse motor drive circuit 104, an electromagnetic clutch drive circuit 105, a thermal head drive circuit 106, a main motor drive circuit 107, a cutter motor drive circuit 108, a solenoid drive circuit 109, and a guide board motor drive circuit 110. In addition, the stencil printing machine of the invention has a plurality of keys such as a printing-operation start key for starting a printing operation after a printing stencil has been made, a ten-key board for setting the number of prints to be formed, and a stop key for temporarily stopping the operation of the printing machine.

In the control system, the CPU 100 is made up of a micro-processor for instance, and the ROM 101 stores a control program for practicing a series of stencil printing steps including a step of making a printing stencil. The RAM stores input data provided by the pressure plate set sensor 20, the stencil detecting sensor 30, the guide board sensor 61, and the printing stencil formation start switch 103. The switch 103 is operated by the operator to start the printing stencil making operation. The pulse motor drive circuit 104 supplies pulses in correspondence to the number of steps which is specified by the CPU, thereby to drive the write/feed motor 18. The electro-magnetic clutch drive motor 105 drives the electro-magnetic clutch 41 in response to an instruction from the CPU 100. The thermal head drive circuit 106 drives the thermal head 48 according to an instruction from the CPU 100 to cause the thermal head to thermally perforate the stencil paper S to obtain a printing stencil. The main motor drive circuit 107 drives the main motor 2 in response to an instruction from the CPU 100. The cutter motor drive circuit 108 drives the cutter motor 19 in response to an instruction from the CPU 100. The solenoid drive circuit 109 drives the guide board solenoid 59 in response to an instruction from the CPU 100. The guide board motor drive circuit 110 drives the guide board motor in response to an instruction from the CPU 100.

In the control system, the CPU 100 receives output data from the pressure plate set sensor 20, the stencil detecting sensor 30, the guide board sensor 61, and the printing stencil making start switch 103, and, according to the control program stored in the ROM 101, detects how the stencil paper S is conveyed, and renews input data for the RAM 102, and applies operating instructions to the pulse motor drive circuit 104, the electro-magnetic clutch drive circuit 105, the thermal head drive circuit 106, the main motor drive circuit 107, the cutter motor drive circuit 108, the solenoid drive circuit 109, and the guide board motor drive circuit 110 to control the operations of the main motor 2, the write/feed motor 18, the cutter motor 19, the electro-magnetic clutch 41, the thermal head 48, the guide board solenoid 59, and the guide board motor 64.

Figure 5:
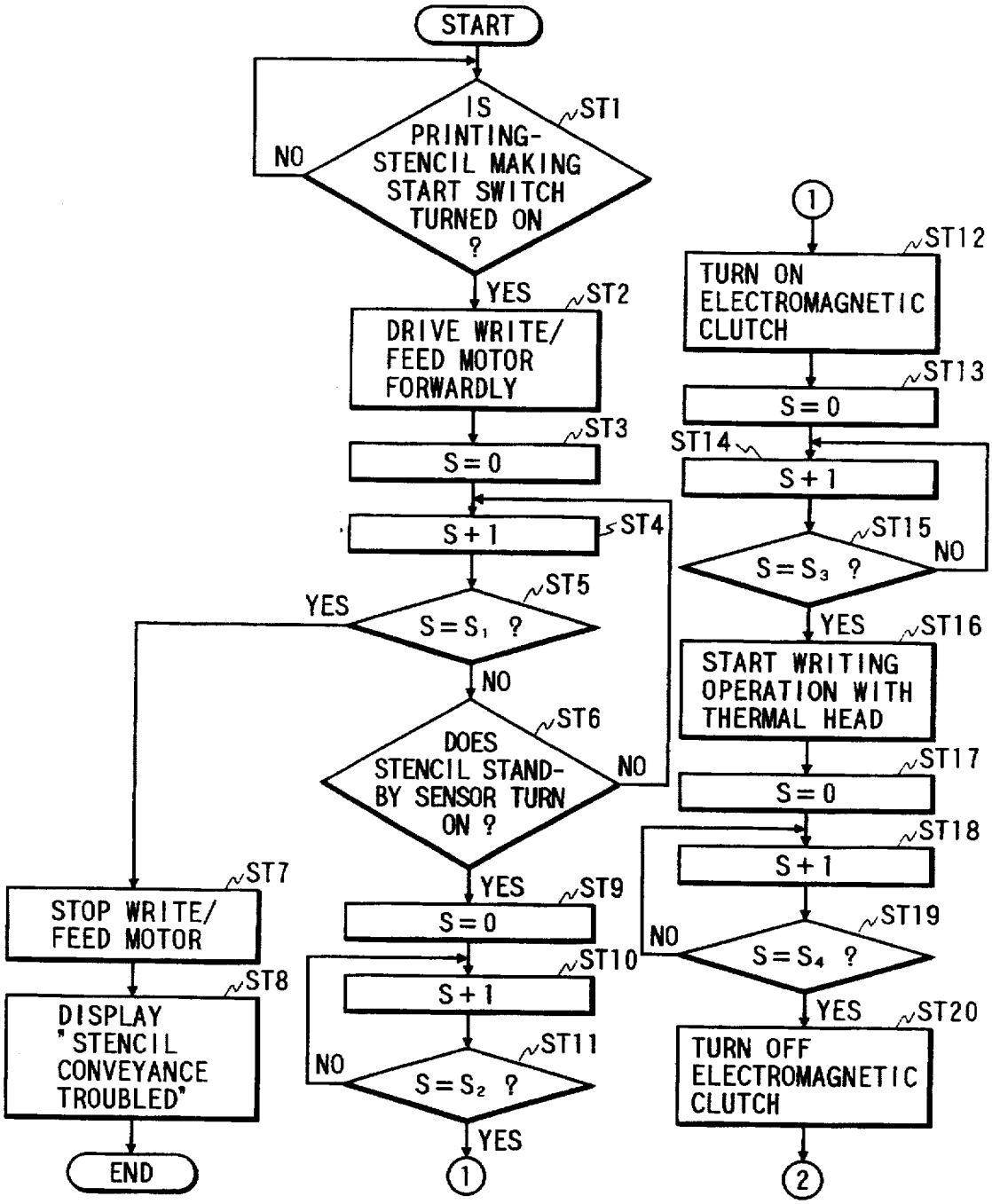
FIGS. 5, 6 and 7 are three parts of a flow chart.
Figure 6:
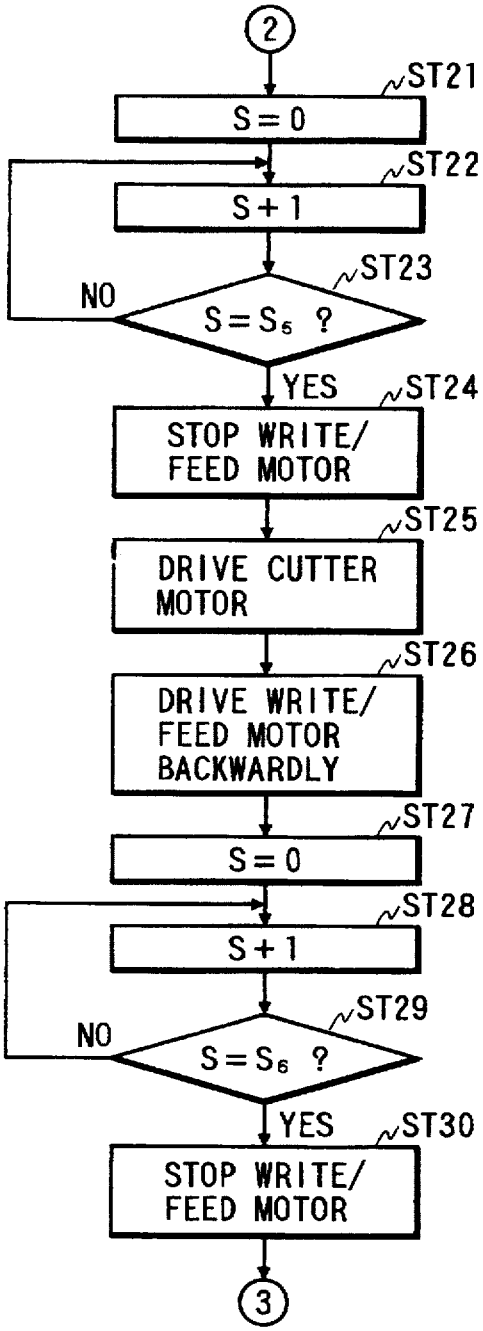
Figure 7:
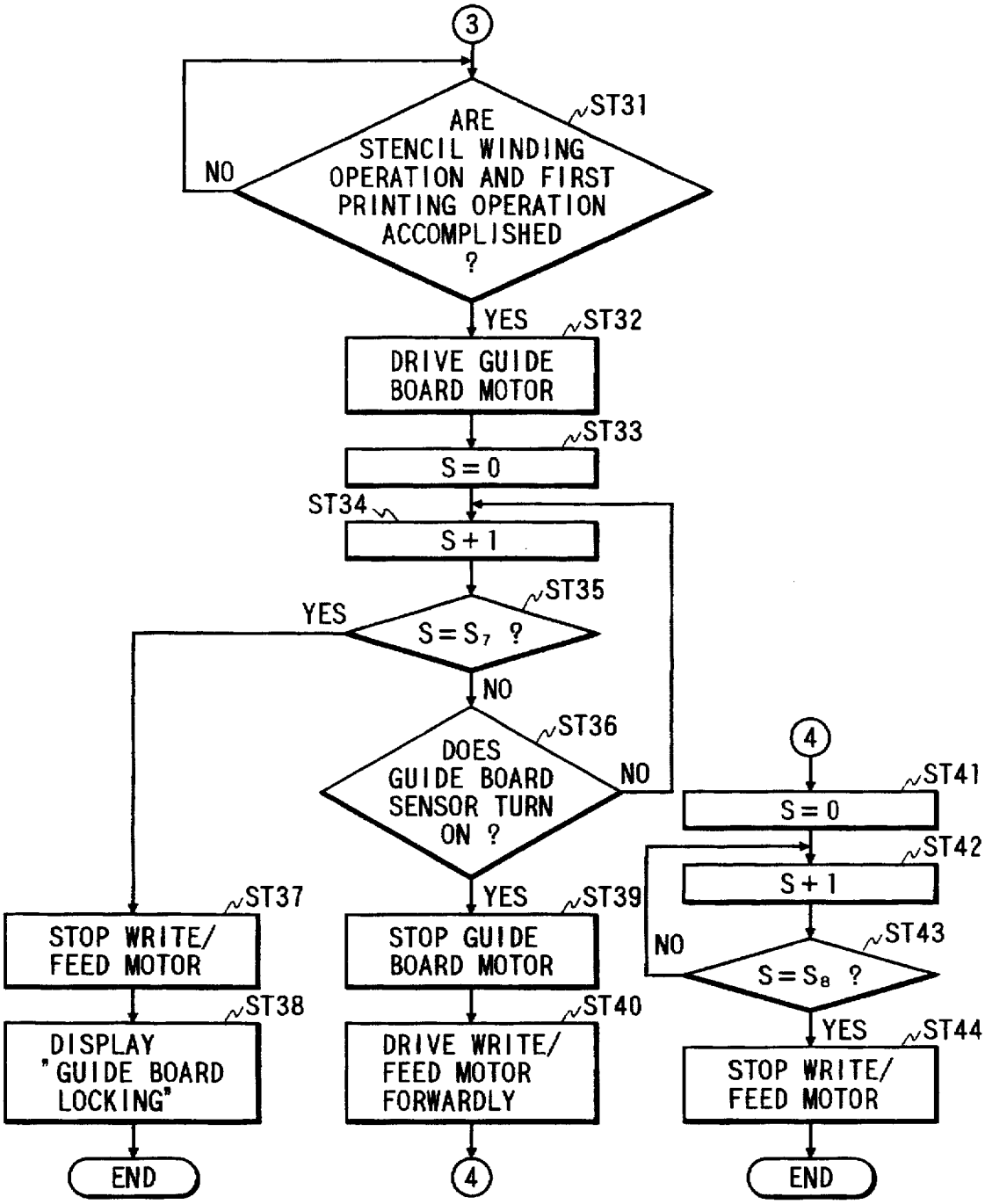
Figure 8:
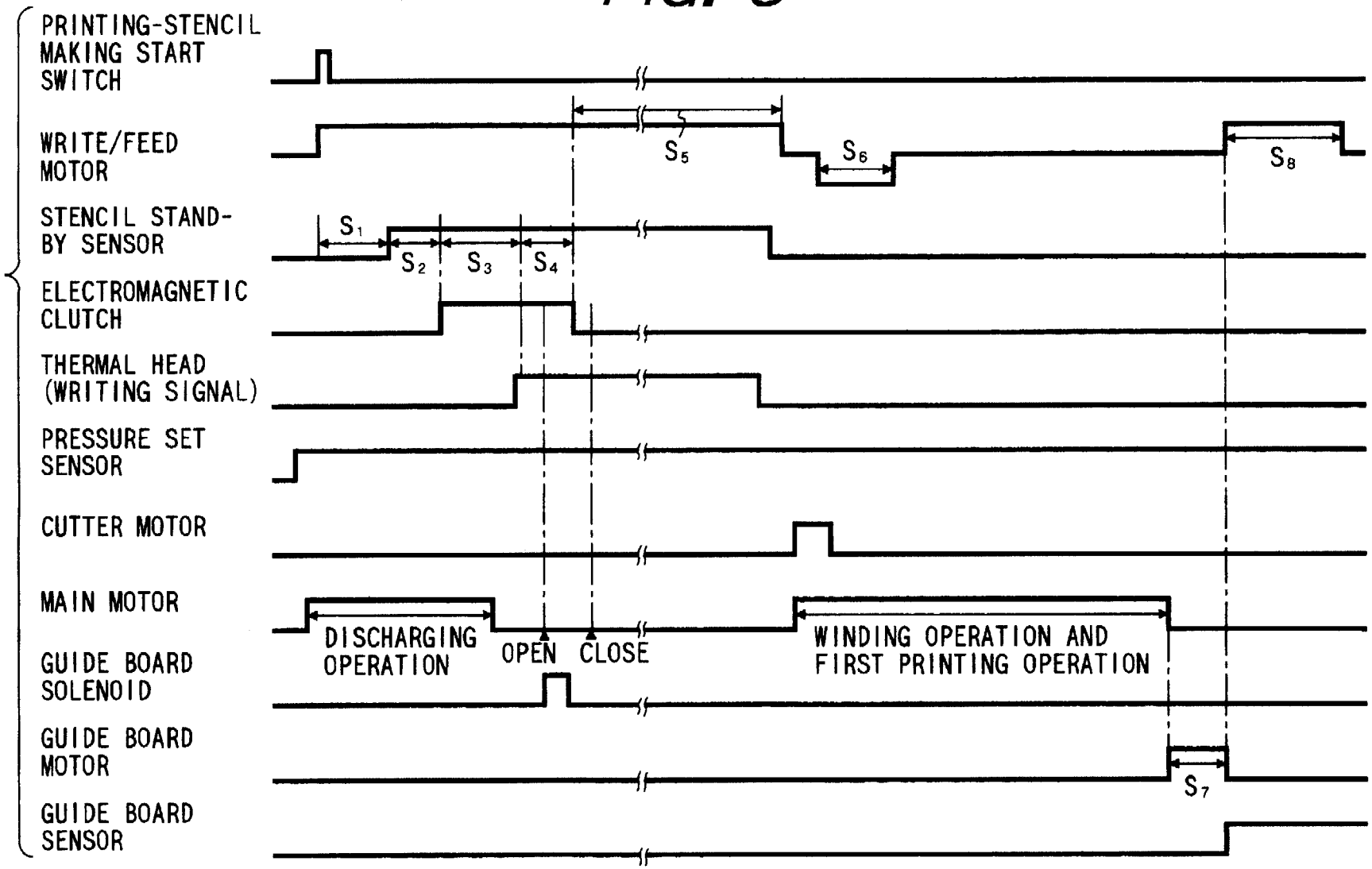
FIG. 8 is a time chart, for a description of various operations which are carried out for the conveyance of a stencil paper with a printing-stencil making start switch operated.

In the stencil printing machine thus organized, the stencil paper S is initially set on the stencil conveying path 14 as was described before, and with the set position as a reference position the conveyance of the stencil paper S is carried out in response to the output signal of the printing stencil making start switch 103 as follows:

FIGS. 5 through 7 are flow charts, and FIG. 8 is a time chart, for a description of various operations which are carried out when the stencil paper is conveyed in response to the operation of the printing stencil making start switch 103.

Before the start switch 103 is turned on, an original for making of a printing stencil is held between an original handling roller 70 and an original handling board 71 as shown in FIG. 2.

When, under the conditions that the pressure plate 10 is closed with respect to the unit body 9, and the pressure plate set sensor 20 is turned on, the start switch 103 is turned on by the operator (Yes in Step ST1), the write/feed motor 18 is turned counterclockwise (in the forward direction) in FIG. 1 (Step ST2). When the motor 18 is turned in the above-described manner, the platen roller is turned counterclockwise in FIG. 1 to convey the stencil paper S towards the drum 1. When the motor 18 is rotated in the forward direction, the stencil stand-by sensor 30 operates to detect the passage of the stencil paper S until the number of steps S of the motor 18 reaches S1 from 0 (zero) (Steps ST3, ST4, ST5 and ST6), thereby to determine whether or not the stencil paper S is smoothly conveyed along the stencil conveying path 14. When the number of steps S reaches S1 from 0 (Yes in Step ST5), the motor 18 is stopped (Step ST7), and the warning "STENCIL CONVEYANCE TROUBLED" is displayed; that is, display is made to indicate that a trouble occurs with the conveyance of the stencil paper S (Step ST8).

On the other hand, when, after the stencil stand-by sensor 30 is turned on before the number of steps S of the motor 18 reaches S1 from 0 (Yes in Step ST6), the motor 18 is rotated in the forward direction until the number of steps S reaches S2 from 0 (Steps ST9, ST10 and ST11), the electro-magnetic clutch 41 is turned on (Step ST12). When the number of steps S of the motor 18 reaches S3 from 0 (Steps ST13, ST14 and ST15), a writing operation with the thermal head 48 is started (Step ST16). In this case, the stencil paper S is conveyed to the writing start position in the stencil conveying path 14 as shown in FIG. 1. During the period of time in which the number of steps S of the motor 18 reaches S3, the main motor 2 is caused to make one revolution, to perform a stencil discharging operation. The stencil discharging operation is carried out as follows: The main motor 2 is driven to turn the drum 1 counterclockwise in FIG. 1, so that the printing stencil which has been used is removed from the drum 1. The printing stencil thus removed is conveyed into a used-stencil accommodating box, so as to be discarded.

In the above-described operation, the number of steps S3 is so selected as to determine a writing position for the stencil paper S (where the latter is processed to form a printing stencil) so that, in the case where an original feeding motor (not shown) for reading an original is driven with the timing of S2, the rotation of the original feeding motor is stabilized before the writing operation with the thermal head is started.

Next, when the number of steps S of the motor 18 reaches S4 from 0 (Steps ST17, ST18 and ST19), and the front end of the stencil paper S reaches the clamp section 3 of the drum 1, the electro-magnetic clutch 41 is turned off (Step ST20). The stencil clamping plate 4 is opened while the number of steps S of the motor 18 reaches S4 from 0. The stencil clamping plate 4 is closed a predetermined period of time after the number of steps S of the motor 18 reaches S4, to hold the front end portion of the stencil paper S which is conveyed. When the stencil clamping plate 4 is opened, the guide board solenoid 59 is turned on for a predetermined period of time, and then turned off. As a result, the link 58 is turned counter-clockwise about the shaft 51, so that the pin **56*a* of the link 58 is disengaged from the hook 50 of the lower guide board 26*a*. And, the relay stencil guide board unit 26** is gradually turned downwardly by its own weight as the stencil paper S being conveyed is slackened as indicated by the two-dot chain line in FIG. 1.

When, after the electro-magnetic clutch 41 is turned off, the motor 18 is rotated in the forward direction until the number of steps S reaches S5 from 0 (Steps ST21, ST22 and ST22), the motor 18 is stopped (Step ST24). And, the cutter motor 19 is driven (Step ST25), to cut the stencil paper S to obtain a printing stencil. Under this condition, the write/feed motor 18 is turned clockwise (in the reverse direction) in FIG. 1 (Step ST26). When the number of steps of the motor 18 reaches S6 from 0 (Steps ST27, ST28 and ST29), the motor 18 is stopped (Step ST30). That is, the front end portion of the stencil paper S thus cut, which is separated from the printing stencil, is moved back towards the platen roller 15 without entering the space 22, so that it is held in the stencil guide board unit 21 with its curling limited by the upper and lower guide boards thereof.

After the stencil paper S has been cut in the above-described manner, the main motor 2 is caused to make two revolutions to perform a stencil winding operation, and a first printing operation. The stencil winding operation is carried out as follows: With the front end of the stencil S held with the stencil clamping plate 4, the main motor 2 is driven to turn the drum 1 counterclockwise thereby to wind the stencil on the drum 1. The first printing operation is carried out as follows: In synchronization with the stencil winding operation, a printing sheet is supplied to the drum 1 from below, and then printed through the printing stencil, to obtain a print. The print thus obtained is delivered onto a sheet discharging stand.

When the stencil winding operation and the first printing operation have been accomplished (Yes in Step ST31), the guide board motor 64 is driven (Step ST32). When the motor 64 is driven in this manner, the guide board sensor 61 determines whether or not the relay stencil guide board unit 26 is moved to the return position during the period of time which elapses until the number of steps S of the motor 64 reaches S7 from 0 (Steps ST33, ST34, ST35 and ST36). When the number of steps S reaches S7 (Yes in Step ST35), the guide board motor 64 is stopped (Step ST37), and the warning "GUIDE BOARD LOCKING" is displayed; that is, display is made to indicate that the relay stencil guide board unit 26 is not moved back to the return position.

When, on the other hand, the guide board sensor 61 is turned on before the number of steps S of the motor 64 reaches S7 (Yes in Step ST36), the motor 64 is stopped (Step ST39). In this case, the relay stencil guide board unit 26 is at the return position with the pin 56*a* of the locking board 56 locked to the hook 50 of the lower guide board 26*a*. Under this condition, the write/feed motor 18 is turned counterclockwise (in the forward direction) in FIG. 1 (Step ST40). When the number of steps S of the motor 18 reaches S8 from 0 (Steps ST41, ST42 and ST43), the motor 18 is stopped (Step ST44). Thus, the front end portion of the stencil paper S separated from the printing stencil and held in the stencil guide board unit 2, is conveyed through the space 22 to the initial set position in the relay stencil guide board unit 26 which is determined by the stencil stopper member 33.

In the above-described embodiment, after the stencil paper S provided in the form of a roll is cut to obtain the printing stencil, the front end portion of the stencil paper S separated from the printing stencil is moved back in the stencil guide board unit 21 located in front of the stencil cutter 23, and then conveyed into the relay stencil guide board unit 26 which is located beyond the stencil cutter 23. Hence, even if the front end portion of the stencil paper S enters the space 22 where the stencil cutter 23 is positioned, it is smoothly conveyed; that is, it can be moved out of the space 22 and held in the stencil guide board unit 21. Furthermore, since the front end portion of the stencil paper S is moved back into the stencil guide board unit 21, and then conveyed into the relay stencil guide board unit 26, the front end portion can be held in the latter 26 until the next stencil forming operation is started. Even if ambient conditions such as ambient temperature and humidity change while the front end portion is held in the relay stencil guide board 26, its curling is limited by the upper and lower guide boards of the relay stencil guide board unit 26. Hence, in the following stencil-making operation, the stencil paper can be positively conveyed to the rotary cylindrical drum 1.

In the stencil printing machine of the invention, after the stencil paper is cut with the cutter to obtain a printing stencil, the front end portion of the stencil paper which is separated from the printing stencil is returned a predetermined distance towards the printing-stencil making means. Hence, even if the stencil paper, when cut, is slackened to cause its front end portion to enter the space which is provided for the cutter, the front end portion can be moved from the space towards the printing-stencil making means. Thereafter, the front end portion is conveyed beyond the cutter. This feature eliminates the difficulty that the stencil paper is not smoothly conveyed with its front end portion entering the space at the position of cutter.

In the stencil printing machine, after the stencil paper is cut with the cutter to obtain a printing stencil, the front end portion of the stencil paper which is separated from the printing stencil is moved back to the guide boards on the side of the printing-stencil making means. Hence, even if the stencil paper, when cut, is slackened to cause its front end portion to enter the space, it can be returned therefrom to the guide boards. Thereafter, the front end portion of the stencil paper is conveyed beyond the cutter to the position where the guide boards are located, and stopped there. Hence, the front end portion of the stencil paper can be held at the guide boards until the next printing-stencil making operation is started. Even if ambient conditions such as ambient temperature and humidity change while the front end portion is held between the guide boards, its curling is limited by guide boards. Therefore, in the following stencil forming operation, the stencil paper can be positively conveyed to the rotary cylindrical drum.

What is claimed is:

1. A stencil printing machine in which a rolled stencil is cut for obtaining a printing stencil of a printing image, said stencil printing machine comprising:

printing-stencil making means including a thermal head and a platen roller, for making the printing stencil from the rolled stencil held and conveyed by said thermal head and said platen roller;

a cutter for cutting the rolled stencil to obtain the printing stencil;

a first guide board unit including a pair of upper and lower guide boards arranged upstream of said cutter as viewed in a stencil conveying direction;

a second guide board unit including a pair of upper and lower guide boards arranged downstream of said cutter as viewed in the stencil conveying direction;

a control means for controlling said platen roller such that a front end portion of the rolled stencil separated from the printing stencil cut by said cutter is moved a predetermined distance backwardly to be held within said first guide board unit, and then moved forwardly to be held within said second guide board unit; and a stopper member arranged near said second guide board unit, wherein said stopper member selectively interrupts a stencil conveying path and stops the rolled stencil at a fixed position within said second guide board unit.

2. A stencil printing machine according to claim 1, further comprising:

detecting means for detecting whether or not the front end portion of the rolled stencil is positioned within said second guide board unit.

3. A stencil printing machine according to claim 1, wherein said upper and lower guide boards of said first guide board are substantially parallel to each other.

4. A stencil printing machine according to claim 1, wherein said upper and lower guide boards of said second guide board are substantially parallel to each other.

* * * * *